United States Patent [19]

Ermolovich et al.

[11] 4,455,854

[45] Jun. 26, 1984

[54] MILL FOR TRANSVERSE ROLLING

[75] Inventors: Vyacheslav I. Ermolovich; Valery A. Klushin; Vladimir I. Sadko; Valery Y. Schukin, all of Minsk, U.S.S.R.

[73] Assignee: Fiziko-Tekhnichesky Institut Akademii Nauk Belorusskoi SSR, Minsk, U.S.S.R.

[21] Appl. No.: 375,035

[22] PCT Filed: Aug. 27, 1980

[86] PCT No.: PCT/SU80/00149

§ 371 Date: Apr. 20, 1982

§ 102(e) Date: Apr. 20, 1982

[87] PCT Pub. No.: WO82/00608

PCT Pub. Date: Mar. 4, 1982

[51] Int. Cl.[3] ..... B21D 7/04

[52] U.S. Cl. ..... 72/90; 72/455

[58] Field of Search ..... 72/88–90, 72/455, 481, 482

[56] References Cited

U.S. PATENT DOCUMENTS

| | | | |
|---|---|---|---|
| 1,973,201 | 9/1934 | Fassinger | 72/88 |
| 3,051,474 | 8/1962 | Helda et al. | 269/234 |
| 3,084,572 | 4/1963 | Starck | 72/88 |
| 3,702,560 | 11/1972 | Weidel | 72/481 |
| 4,016,738 | 4/1977 | Puchko et al. | 72/469 |
| 4,095,446 | 6/1978 | Zabava et al. | 72/88 |

FOREIGN PATENT DOCUMENTS

| | | | |
|---|---|---|---|
| 58480 | 11/1967 | German Democratic Rep. | 72/88 |
| 38-7208 | 5/1963 | Japan | 72/88 |
| 951999 | 3/1964 | United Kingdom | 72/302 |
| 759187 | 8/1980 | U.S.S.R. | 72/88 |

OTHER PUBLICATIONS

Physico-Technical Institute of the USSR Academy of Sciences entitled "Mill for Cross-and-Taper Rolling," 1980.

*Primary Examiner*—Daniel C. Crane

*Attorney, Agent, or Firm*—Fleit, Jacobson, Cohn & Price

[57] ABSTRACT

A mill for cross rolling, comprising a detachable housing (1) inside which there are disposed parallel plates (4) and (5) provided with wedge-shaped deforming tools (9) and (10). On upper and lower portions (2) and (3) of the housing (1) there are provided projections (13) having through coaxial openings whereinto are introduced rotary pins (14) and (15) having cylindrical and shaped portions (16) and (17). The rotary pins (14) and (15), while being in one position, rigidly connect the portions (2) and (3) of the housing (1) and, when turned by an angle of 180°, allow the load to be operatively removed from a seizured billet.

6 Claims, 7 Drawing Figures

MILL FOR TRANSVERSE ROLLING

TECHNICAL FIELD

The invention relates to the design of processing equipment intended for plastic metal working, and particularly to mills for cross rolling.

BACKGROUND ART

Despite the fact that mills for cross rolling have been developed comparatively long time ago, are widely used in the industry and their design is constantly improving, it has been impossible up to present time to eliminate the possibility of seizing a billet being rolled between shaping elements. The seizure of the workpiece may be caused by its insufficient preheating, incorrect selection of conditions of rolling or shaping tools etc. The amount of losses born by the enterprise in the given emergency situation depends on the fact how quickly the hot billet can be removed from the mill after the seizure. In this case the losses will be determined not only in terms of the working time during the downtime of the mill, but also by the cost of damaged shaping tools. Under the conditions of a long-time contact between the heated billet and the shaping tool, the metal of the latter is subjected to undesirable phase transformations (e.g. tempering). Also possible is the diffusion welding between the billet and the tool, thereby making the damage of the latter inevitable.

Known in the art are attempts to develop mills whose designed is provided with means for quickly eliminating an accident (GDR Pat. No. 584,80). In accordance with this patent, the mill comprises a non-detachable housing wherein are mounted for reciprocating motion parallel plates carrying a shaping tool. The plates are carried by for rollers whose eccentric shafts are fastened on the housing. In the case of a seizure it is sufficient to rotate the roller shafts following which the billet may be withdrawn. Thus, the mill can be loosened comparatively quickly which fact constitutes an obvious advantage of the described mill. However, the introduction of bearing rollers and eccentric shafts into the mill design has adversely affected the rigidity thereof. In the course of mill operation the eccentric shafts get bent under the action of great loads (up to 30 tons), thereby causing a change in the distance between deforming tools. Though the amount of deflection of the shafts is small, it can be sufficient for defective products to appear. For this reason, the above described mill can be employed for rolling only those billets which will be subsequently subjected to turning.

A mill for cross rolling disclosed in U.S. Pat. No. 4,016,738 (see also the advertising booklet "Stan poperechno-klinovoy prokatki", Physico-technical Institute of the Belorussian SSR Academy of Sciences, Minsk, "Nauka i tekhnika" Publishers, 1980) possesses a considerably higher rigidity. This mill comprises a detachable box-shaped housing having upper and lower portions. The upper portion is fastened on the lower one by a plurality of screws which are screwed into the lower portion of the housing. Inside the housing are disposed parallel plates of which one is mounted on guide members for reciprocating motion, while the other is rigidly fastened on the housing. On the plate surfaces facing each other there are fixed wedge-shaped deforming tools. The movable plate is coupled with a drive for moving the same. A comparatively high ridigity of such a mill is ensured by the fact that the plates are carried directly by the housing whose rigidity is considerably higher than that of the shafts in the above described analog. However, such an increase in the rigidity in the above described structure caused a certain degradation of such an important operating characteristic as maintenance suitability. In particular, in the case of the mill seizure about 50 screws are to be unscrewed to release the upper plate and to withdraw the billet. It is obvious that such an operation requires a considerable time during which the hot billet may locally increase the temperature of deforming tools up to a dangerous limit (e.g. up to a temperature of the beginning of phase transformations in the tool metal). It is to be noted that the attempts to eliminate this disadvantage by decreasing the number of screws turned out to be unsuccessful since they resulted in a considerable decrease in the mill rigidity.

DISCLOSURE OF INVENTION

The invention is based on the problem to provide a mill for cross rolling wherein the design of a housing and detachable connection of the parts thereof ensure a sufficiently high rigidity and simultaneously permit a quick release of the plates at minimum time losses.

The object set forth is attained by that in a mill for transverse rolling, comprising a detachable box-shaped housing having an upper and lower portions coupled therebetween by a detachable connection, parallel plates disposed inside the housing, at least one of said plates being mounted on guide members for reciprocating motion, wedge-shaped deforming tools mounted on surfaces of said plates facing each other, and a drive connected at least with one of said plates, according to the invention, along the joint on the contacting surfaces of the upper and lower housing portions there are provided projections introduced into corresponding recesses, through coaxial openings being provided within said projections, whereinto are introduced rotary pins having cylindrical portions dispersed inside openings of projections of one portion of the housing, and shaped portions located inside openings of projections of the other portion of the housing, and having such a cross-section in which a contact arc between each shaped element and an inner portion of the projection is defined by a central angle which is less than 180°. With such an arrangement of the housing portions and connection therebetween, it is sufficient to turn two pins by an angle of 180° to release the plates. In the working position the rotary pins take up the load along the whole length thereof, and while working in shear, ensure a sufficiently high rigidity.

The simpliest and the most suitable in manufacture is a modification of the device wherein each shaped portion of the rotary pins has the form of a segment in cross-section whose radius is equal to that of the inner opening of the projection, and the center thereof lies on the axis of a corresponding rotary pin. Such a modification is applicable in the mills intended for rolling small workpieces. In accordance with another modification, each shaped portion of the rotary pins is constructed in the form of a cylinder being eccentric relative to the above cylindrical portions and having a smaller diameter, the eccentricity being equal to ½ of the difference between the diameter of the cylindrical portion and that of the shaped portion. Such rotary pins possess a higher strength and can be employed in the manufacture of workpieces whose diameter is up to 40 mm.

The most reliable in operation is a modification wherein each shaped portion of the rotary pins is defined by conjugated cylindrical surfaces, the radius of each surface being equal to that of the cylindrical portion and the axes thereof being parallel one another, the axis of the contact cylindrical surface coinciding the axis of a corresponding rotary pin, while the axis of the other cylindrical surface is shifted along the radius towards the contact cylindrical surface.

To accomplish an accurate clamping of the rotary pins in the working position, it is desirable that in the upper portion of the housing opposite at least one of the shaped portions of each rotary pin be provided through threaded openings whereinto screws are screwed home into a corresponding shaped portion.

In the rolling mills intended for rolling large workpieces it is preferred that the ends of the rotary pins, projecting from the housing, be connected with the rotary drive via a reduction gear.

BRIEF DESCRIPTION OF DRAWINGS

The invention is further explained in terms of specific embodiments thereof with reference to the accompanying drawing, in which.

BEST MODE FOR CARRYING OUT THE INVENTION

Figure 1:
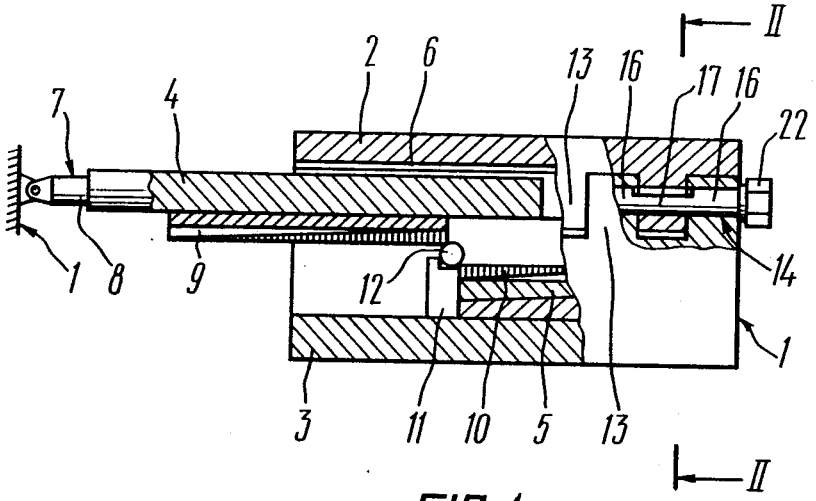
FIG. 1 shows a mill for cross rolling, side view with partially broken sections, of the invention.

A mill for cross rolling of the invention comprises a housing 1 (FIG. 1) having a box-shaped form. Said housing 1 consists of an upper and lower portion 2 and 3. Inside the housing 1 there are disposed parallel plates 4 and 5. At least one of these plates, in the given instant the upper plate 4, is mounted on guides 6 for reciprocating motion. The lower plate 5 is stationary fastened on the housing 1. On the housing 1 there is mounted a drive 7 constructed in the form of a power cylinder 8 whose rod is connected with the plate 4. It is obvious that the subject of the invention will not change in the case where both the plates 4 and 5 will be made movable.

On the plates 4 and 5 there are mounted wedge-shaped deforming tools 9 and 10. Said tools 9 and 10 are fixed on the surfaces of the plates 4 and 5, facing each other. The wedge-shaped deforming tools 9 and 10 are directed with the crests thereof towards one another. In front of the lower plate 5 is mounted a tray 11 whereto, prior to the beginning of treatment, a billet 12 to be rolled is laid.

Figure 2:
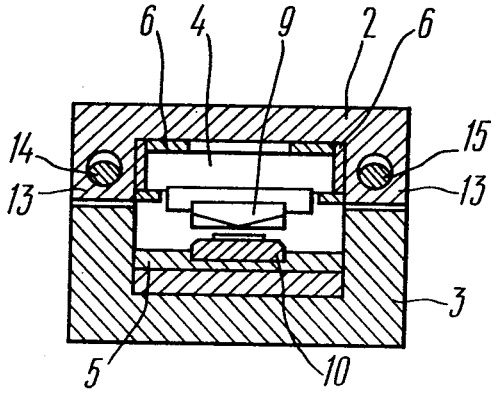
FIG. 2 shows a sectional view of the mill along line II—II in FIG. 1, of the invention (billet not shown)

According to the invention, along the joint on the contacting surfaces of the upper and lower portions 2 and 3 of the housing 1 there are provided projections 13 and corresponding recesses. The projections 13 of the upper portion 2 are introduced into the corresponding recesses of the lower portion 3. The projections 13 of the lower portion 3 are introduced into the corresponding recesses of the upper portion 2 of the housing 1. Within said projections 13 of the upper and lower portions 2 and 3 there are made through coaxial openings. Into said openings are introduced rotary pins 14 and 15 (FIG. 2). Each rotary pin, e.g. the pin 14, is provided with cylindrical portions 16 and shaped portions 17. The cylindrical portions 16 are disposed within the openings of the projections 13 of the lower portion 3 of the housing 1 (FIG. 3), and the shaped portions 17 are located within the openings of the projections 13 of the upper portion 2 of the housing 1. Each shaped portion 17 has such a cross-section in which an arc 18 of the contact thereof with the inner surface of the opening provided within the projection 13 is defined by a central angle $\alpha$ which is less than 180°. To observe this condition, the form of the cross-section of the shaped portion 17 can be various.

Figures 3, 4, 5, 6:
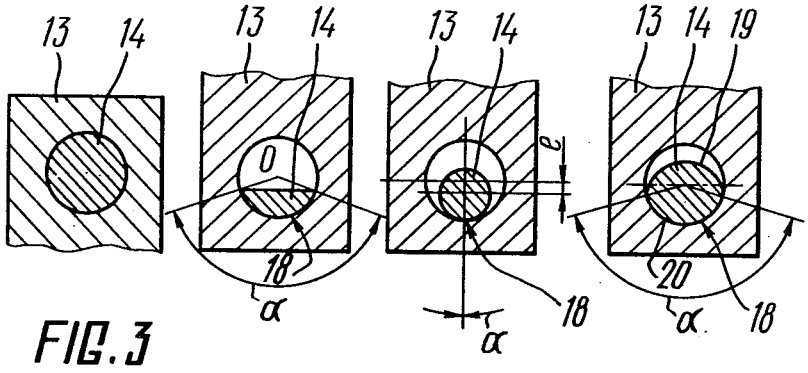
FIG. 3 shows a sectional view of a portion of the projection and a cylindrical portion of the rotary pin, of the invention.
FIG. 4 shows a first modification of the rotary pin and shows a cross-sectional view of a shaped portion and a portion of the projection, of the invention.
FIG. 5 shows a second modification of the rotary pin, of the invention.
FIG. 6 shows a third modification of the rotary pin, of the invention.

In particular, the simpliest and the most suitable in manufacture is a modification of the rotary pins 14 and 15 which is shown in FIG. 4. As can be well seen in this figure, the shaped portion 17 has the form of a segment in cross-section. The radius of this segment is substantially equal to that of the inner opening provided in the projection 13. The arc 18 of the segment is defined by the central angle $\alpha$ which is less than 180°. The center O of the segment lies on a geometrical axis of the corresponding rotary pin 14 or 15.

According to another embodiment of the invention, each shaped portion 17 (FIG. 5) is made in the form of a cylinder. This cylinder is eccentric relative to the cylindrical portions 16 of the given rotary pin 14 or 15. A diameter $D_1$ of this cylinder is less than a diameter $D_2$ of the cylindrical portion 16, therefore the shaped portion 17 does not project relative to the portions 16. An eccentricity e is equal to half a difference between the diameters $D_2$ and $D_1$ of the cylindrical portion 16 and the shaped portion 17 ($e=[D_2-D_1]/2$). The central angle $\alpha$ defining the arc 18 of contact between the shaped portion 17 and the inner surface of the projection 13, is in the given case equal to zero ($\alpha=0$). Thus, the shaped portion 17 contacts the inner surface of the projection 13 with one generatrix thereof. Between the remaining part of the surface of the portion 17 and the inner surface of the projection 13 is formed a gap having the form a sickle of in cross-section.

In accordance with the third embodiment of the invention, each shaped portion 17 of the rotary pins 14 and 15 is defined by conjugated cylindrical surfaces 19 and 20 as can be well seen in FIG. 6. The radius of each of said surfaces 19 and 20 is equal to that of the cylindrical portion 16. A geometrical axis of the contact surface 20 coincides with that of the rotary pin 14 or 15. A geometrical axis of the other cylindrical surface 19 is parallel thereto and is shifted along the radius towards the contact surface 20. Thus, the surface 19 of the shaped portion 17 and the inner surface of the opening provided within the projection 13 define a gap having the form of a sickle in cross-section.

According to the preferred modification of the invention (FIG. 7), in the upper portion 2 of the housing 1 opposite at least one of the shaped portions 17 of each rotary pin 14, 15 are provided threaded through openings. Into these openings screws 21 are screwed home into a corresponding shaped portion 17.

Figure 7:
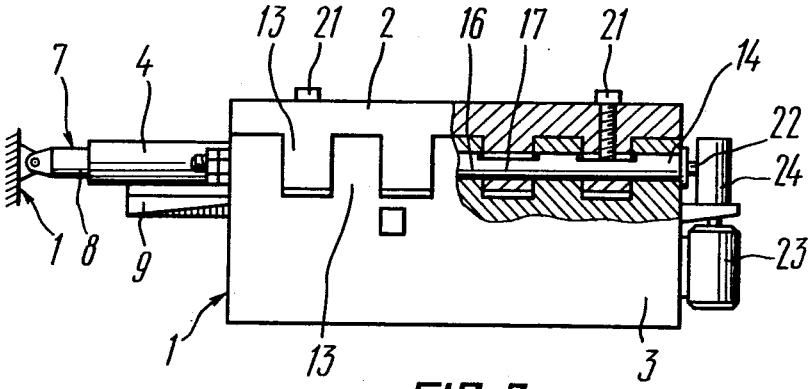
FIG. 7 shows the mill of the invention provided with clamps of rotary pins and a drive for rotating the pins, of the invention.

Ends 22 of the rotary pins 14 and 15, projecting from the housing 1, can be constructed in the form of hexahedrons for a wrench (FIG. 1). On these ends there can be fastened levers or hand wheels for manual rotation (not shown). However, in the mill designed for rolling billets having a diameter of 20 to 40 mm, according to the invention, is provided a rotary drive 23 (FIG. 7). The drive 23 is mounted on the housing 1 and is connected with the ends 22 of the rotary pins 14 and 15 via a reduction gear 24.

The above described mill operates as follows.

The billet 12 is placed between the plates 4 and 5 on the tray 11. A working medium is fed under a pressure into the cavity of the power cylinder 8. The power cylinder 8 shifts the plate 4. In so doing, the billets 12, while being rounded off between the wedgeshaped deforming tools 9 and 10, acquire a desired shape. In the working position the rotary pins 14 and 15 are turned as shown in FIGS. 1, 2 and rigidly couple the upper and lower portions 2 and 3 of the housing 1.

In the case of seizuring the billet 12 in the course of rolling, the power cylinder 8 is disconnected from the main line for feeding a pressurized working medium (not shown). Following this, the rotary pins are turned by an angle of 180°. In such a position each shaped portion 17 contacts the inner surface of the opening provided within the projection 13 only at the top. From below, between each shaped portion 17 and the inner surface of the projection 13 of the upper portion 2 is provided a gap allowing the upper portion 2 to be shifted upwards. Thus, the upper portion 2, released from the rigid connection with the lower portion 3 of the housing 1, stops exerting power action on the billet 12, and this billet can be easily withdrawn from the mill. For this end, it is sufficiently to impart the plate 4 a motion in the direction opposite to the working one, using the power cylinder 8.

The modification of the mill, shown in FIG. 7, operates mainly as described above. However, in the working position the rotary pins 14 and 15 are clamped using the screws 21. In the case of seizuring the billet 12, these screws are to be unscrewed. Turning the pins 14 and 15 by an angle of 180° is accomplished by means of the drive 23. The drive 23 imparts the rotation to the reduction gear 24 which turns the pins 14 and 15.

Industrial Applicability

The present invention can be used in machine engineering in cross rolling of step-shaped shafts and other workpieces having the form of solids of revolution.

We claim:

1. A mill for cross rolling, said mill comprising: a detachable box-shaped housing having upper and lower portions, said upper and lower portions of said housing being releasably interconnected along contacting surfaces; projections and recesses provided along a line between said contacting surfaces of said upper and lower portions of said housing such that each of said upper and lower portions are provided with projections and recesses, said projections having coaxial through openings formed therein; rotary pins carried in said coaxial openings thereby interconnecting said upper portion to said lower portion, said rotary pins having cylindrical portions received in said openings formed in said projections of the lower part of said housing, said rotary pins having shaped portions being arranged in said openings formed in said projections of the upper portion of said housing, said shaped portions each having a cross-section that permits a contact arc between each shaped element and an inner portion of the opening of the projection to be defined by a central angle of less than 180°; parallel plates received in the housing, at least one of said plates being mounted on guides for reciprocation; wedge-shaped deforming tools mounted on opposite surfaces of said plates; and drive means connected with at least one of said plates.

2. A mill as claimed in claim 1, wherein each shaped portion of the rotary pins has the form of a segment in cross section, the segment having a radius equal to that of the opening in the projection and having the center thereof aligned with a corresponding rotary pin.

3. A mill as claimed in claim 1, wherein each shaped portion of said rotary pin is made in the form of a cylinder offset relative to said cylindrical portions and having a smaller diameter than said cylindrical portions, the offset being equal to ½ the difference between the diameter of the cylindrical portion and that of the shaped portion.

4. A mill as claimed in claim 1, wherein each shaped portion of the rotary pins is defined by conjugated cylindrical surfaces, the radius of each cylindrical surface being equal to that of a cylindrical portion and the axes thereof being parallel, the cylindrical contact surface between said pin and said cylindrical portion being aligned with a corresponding rotary pin, while the other cylindrical surface is offset along a radius toward the contact cylindrical surface.

5. A mill as claimed in claim 1, wherein the upper portion of the housing opposite at least one of the shaped portions of each rotary pin includes threaded through openings adapted to receive screws to clamp the associated rotary pins.

6. A mill as claimed in claim 1, wherein ends of said rotary pins project from the housing and are connected with a rotary drive through a reduction gear.

* * * * *